US005170961A

United States Patent [19]

Bolz et al.

[11] Patent Number: 5,170,961

[45] Date of Patent: Dec. 15, 1992

[54] TEXTILE YARN CARRIER WITH YARN TAIL ACCOMMODATION BASE AND CARRIER END HOLDER CAP

[75] Inventors: Hans-Peter Bolz; Samuel F. Adams, Greenville, S.C.

[73] Assignee: Sonoco Products Company, Hartsville, S.C.

[21] Appl. No.: 887,297

[22] Filed: May 22, 1992

[51] Int. Cl.[5] ..... B65H 54/42; B65H 75/10; B65H 75/28; B65H 49/26

[52] U.S. Cl. ..... 242/18 DD; 242/18 PW; 242/118.3; 242/118.32; 242/125.1; 242/129.51

[58] Field of Search ..... 242/18 DD, 129.51, 118.3, 242/118.31, 118.32, 18 PW, 18 R, 125.1

[56] References Cited

U.S. PATENT DOCUMENTS

| | | |
|---|---|---|
| 1,991,880 | 2/1935 | Chaffin . |
| 2,651,479 | 9/1953 | Bauer . |
| 2,827,244 | 3/1958 | Perry . |
| 3,300,160 | 1/1967 | Consoletti . |
| 3,321,901 | 5/1967 | Adams et al. . |
| 3,417,940 | 12/1968 | Hawkins . |
| 4,063,696 | 12/1977 | Kelly et al. . |
| 4,428,541 | 1/1984 | Novak . |
| 4,700,834 | 10/1987 | Martinez . |
| 4,700,904 | 10/1987 | Martinez . |
| 4,848,686 | 7/1989 | Demuth et al. . |
| 5,014,928 | 5/1991 | Gandy et al. . |

*Primary Examiner*—Stanley N. Gilreath
*Attorney, Agent, or Firm*—Bell, Seltzer, Park & Gibson

[57] ABSTRACT

A textile yarn carrier adapted to receive a yarn tail at the base thereof without breaking the yarn tail. The yarn carrier includes a body having an outer face about which yarn may be wrapped, an inner face, and an annular face at its bottom end. A plurality of adjacent, circumferentially oriented, semielliptical depressions are formed in the bottom face of the yarn carrier. Each depression extends from the outer face, radially across the bottom face, and upwardly along and into the inner face. In the preferred embodiment, the depressions are uniform in size and are spaced generally evenly around the periphery of the body, so that the bottom and inner faces of the yarn carrier are adapted to guide and receive a yarn tail in at least one yarn protecting depression on each side of the body. An end holder cap for mating with the bottom end of the textile yarn carrier is also provided. The end holder cap has an annular flange for contacting the bottom face of the yarn carrier at a plurality of points intermediate each semielliptical depression, and a resilient circumferential face for engaging the inner face of the carrier at a plurality of points intermediate each depression. Thus, when the yarn carrier is mounted on the end holder cap, each yarn protecting depression cooperates with an associated area of the end holder cap to define a passage for receiving a yarn tail.

34 Claims, 2 Drawing Sheets

TEXTILE YARN CARRIER WITH YARN TAIL ACCOMMODATION BASE AND CARRIER END HOLDER CAP

FIELD OF THE INVENTION

The present invention relates to a textile yarn carrier. More specifically, the invention relates to a textile yarn carrier adapted to accommodate a yarn tail passing between the yarn carrier and an associated end cap without breaking the yarn tail.

BACKGROUND OF THE INVENTION

In the textile industry, it has long been the practice to store and transport finite quantities of yarn by winding yarn around a central rigid textile yarn carrier. Frequently, the yarn carrier is a body that is cylindrical, conical, frustroconical, or spool-like in shape, although other forms may sometimes be used. The yarn is wrapped around the body of the carrier by rotating the carrier and feeding the yarn to the carrier from a source, so that the yarn is wrapped circumferentially about the carrier. This practice has been found particularly convenient because a relatively large quantity of yarn may be stored in a compact package that is easy to handle and which readily provides for easy removal of the yarn when it is subsequently needed in a textile operation such as weaving or knitting.

The yarn carrier is often cylindrical or frustroconical in shape so that the yarn stored thereon may be easily removed by drawing the loose end of the yarn over the small end of the carrier. A wound segment of yarn on a carrier is sometimes referred to a partial yarn package.

It has been found desirable to wind the yarn on the textile yarn carrier so that a yarn "tail" extends from the base of the carrier. The yarn tail is provided so that the end of the yarn on a first yarn package may be tied to the leading end of the yarn on a successive yarn package. Then, when all the yarn on the first yarn package has been consumed, the yarn on the second package will be drawn off for use. This arrangement has been found particularly advantageous when the wound yarn packages are used on automatic textile machinery, such as looms, circular knitting machines or the like, since the knitting or other textile machine may be operated continuously even though the first yarn package may have been exhausted.

The yarn tail is generally formed prior to winding the yarn on the carrier. A yarn segment is first extended linearly across the base of the carrier transverse to the longitudinal axis of the carrier. When winding is accomplished on an automatic yarn winding machine, the carrier is then urged by mechanical means into engagement with a rotatable end holder cap, which may also be called a base plate or chuck, having a suitable size for mating with the open bottom end of the yarn carrier. The relatively smaller upper end of the yarn carrier is engaged by a nose cap or nose holder, which is also rotatable. Some other suitable holder or support for the nose of the yarn carrier may also be used. The end holder cap and nose cap are arranged to grip the carrier so that it can be driven in rotary fashion by associated winding apparatus.

Generally, the yarn tail is trapped between the end holder cap and textile yarn carrier by the engagement thereof. Rotation of the yarn carrier and end holder cap pulls the yarn towards the carrier from a yarn source, thus causing the yarn to be wrapped circumferentially about the outer face of the carrier. The position of the yarn along the length of the carrier is moved over the length of the carrier to distribute the yarn evenly over the carrier. After numerous rotations, a sufficient amount of yarn may be wound about the outer face of the carrier.

In the past, the industry has encountered problems with abrasion or severance of the yarn tail during the winding process due primarily to engagement of the yarn tail between the textile yarn carrier and the end holder cap. For example, the yarn tail may be severed when the yarn carrier is urged into position against the end holder cap. Frequently, the yarn may be broken by a pinching action generated between the end holder cap, base plate or chuck and the yarn carrier while the carrier and end cap are in rotation. Alternatively, the yarn may be severed due to relative, sliding motion between the yarn tail and the yarn carrier as the yarn carrier is rotated. Severance of the yarn tail is sometimes caused by burrs or other irregularities on the inner or bottom faces of the textile yarn carrier.

Yarn tail breakage and abrasion problems are generally exacerbated when the yarn carrier is made of a relatively hard material such as plastic or the like. For example, the bottom edge and inner face of a hard, plastic yarn carrier may not be sufficiently resilient for the face of the yarn carrier to "give" or form an indentation for receiving the yarn tail when the carrier is positioned on an end holder cap or chuck. Thus, the presence of the yarn interferes with the loading of the carrier onto the end holder cap. As a result, the force that is used to urge the carrier onto the cap is localized, at least in part, on the portions of the yarn tail that extends between the base of the carrier and the end holder cap. In contrast, if the carrier were made of a softer, more resilient material such as paper or cardboard, the interference between the yarn and the carrier could be alleviated by localized indentation of the fibers comprising the body of the carrier.

In recognition of these problems, one prior attempt to minimize yarn severance has focused on polishing, or beveling, the corner between the bottom annular face and inner face of the textile yarn carrier, as shown in U.S. Pat. No. 5,014,928 to Gandy, et al. The Gandy '928 approach, however, has been found useful primarily for textile yarn carriers made of paper having fibers that are relatively soft, which provide a cushion for the yarn tail when trapped between the carrier and the end holder cap.

Another prior attempt to minimize yarn tail breakage is seen in U.S. Pat. Nos. 4,700,834 and 4,700,904 to Martinez. The Martinez '834 and '904 patents describe a plurality of short, relatively narrow, spirally extending grooves formed in the inner face of the textile yarn carrier for gripping the yarn to prevent breakage of the yarn by relative movement between the yarn carrier and the end holder cap. However, this approach is not believed to have sufficiently alleviated the problem of yarn tail breakage.

SUMMARY OF THE INVENTION

The present invention provides a textile yarn carrier having a base adapted to accommodate a yarn tail and for minimizing breakage of the yarn tail during winding of the yarn onto the yarn carrier. The textile yarn carrier of the invention may be inexpensively made of a rigid polymeric material or paper while nevertheless providing a means for reducing yarn tail breakage. The invention also provides an associated end holder cap, base plate or chuck, for the yarn carriers of the invention which can minimize relative movement between the yarn and the yarn carrier during winding.

The textile yarn carrier of the invention has a body that may be generally cylindrical, conical, frustroconical, or spool-like in shape, although other suitable forms may be used. The carrier has an outer face about which yarn may be wrapped circumferentially, an inner face, and an annular bottom face which extends between the inner and outer faces. A plurality of adjacent, circumferentially oriented, semielliptical concave depressions are formed in the bottom annular face for receiving and protecting a yarn tail. The depressions are separated by intermediate, convex raised areas which are preferably smaller than the depressions. Each depression extends in a radial direction from the outer face across the bottom face and upwardly along and into the inner face to form a recessed area for receiving a yarn tail.

Advantageously, the depressions are uniform in size and are spaced generally evenly around the periphery of the yarn carrier. The yarn carrier of the invention thus has a base that is adapted to guide a yarn tail into at least one yarn protecting depressions on opposite sides of the carrier since a yarn tail stretched across the base of the carrier will be urged to slide off the raised areas into the adjacent depressions.

In a preferred embodiment, the width of the depressions, as measured between peaks of adjacent raised areas, is substantially greater than the diameter of the yarn received on the carrier. Likewise, the maximum depth of the depressions, as measured from the peaks of the raised areas, is preferably slightly less than the diameter of the associated yarn. Alternatively, the maximum depth of the depressions may be greater than the diameter of the yarns so long as the points of minimum central depth of the passages defined between the depressions and the end holder cap, base plate or chuck are less than the yarn diameter. As explained below, the minimum central depth of the passages may be smaller than the maximum depth of the depressions due to compression of the resilient material on the end holder cap.

In another aspect, an end holder cap, base plate or chuck is provided for matingly engaging the bottom end of the yarn carrier of the invention. The end holder cap has an annular flange for contacting the bottom annular face of the yarn carrier at a plurality of points intermediate each semielliptical depression. The end holder cap also has a resilient circumferential face for engaging the inner face of the yarn carrier at a plurality of points intermediate each depression in a region adjacent the bottom face. Thus, when the yarn carrier is mounted on the end holder cap, the yarn protecting depressions cooperate with associated areas of the annular flange and resilient circumferential face to define a plurality of passages. Each passage has a sufficient width and depth to accommodate a yarn tail overlying the bottom face of the yarn carrier, but is small enough that a yarn tail within any particular passage is frictionally engaged between the resilient circumferential face and an associated depression. Preferably, the depth of the passages is sufficient to accommodate the yarn tail without substantially deforming the yarn, especially when light or fragile yarns are wound on the yarn carrier.

The textile yarn carrier may be mounted on the end holder cap such that a yarn tail is frictionally engaged between the base of the carrier and the end holder cap. Thus, the end holder cap and carrier may be rotated to draw a length of yarn onto the outer face of the carrier without breaking the yarn tail or having the secured yarn tail slip loose.

The invention provides for the use of yarn carriers made of relatively hard materials such as plastic while minimizing damage to the yarn tail. The carrier may, alternatively, be made of paper or cardboard. The invention also facilitates use of yarn carriers in conjunction with automatic yarn winding equipment.

BRIEF DESCRIPTION OF THE DRAWINGS

In the drawings which form a portion of the original disclosure of the invention.

DETAILED DESCRIPTION OF THE PREFERRED EMBODIMENT OF THE INVENTION

In the following detailed description of the invention, various preferred embodiments are described in order to provide a full and complete understanding of the invention and its preferred embodiments. It will be recognized that although specific terms are employed, these are employed in the descriptive and not in the generic sense, and it will be understood that the invention is susceptible to numerous and various alternatives, modifications and equivalents as will be apparent to the skilled artisan.

Figure 1:
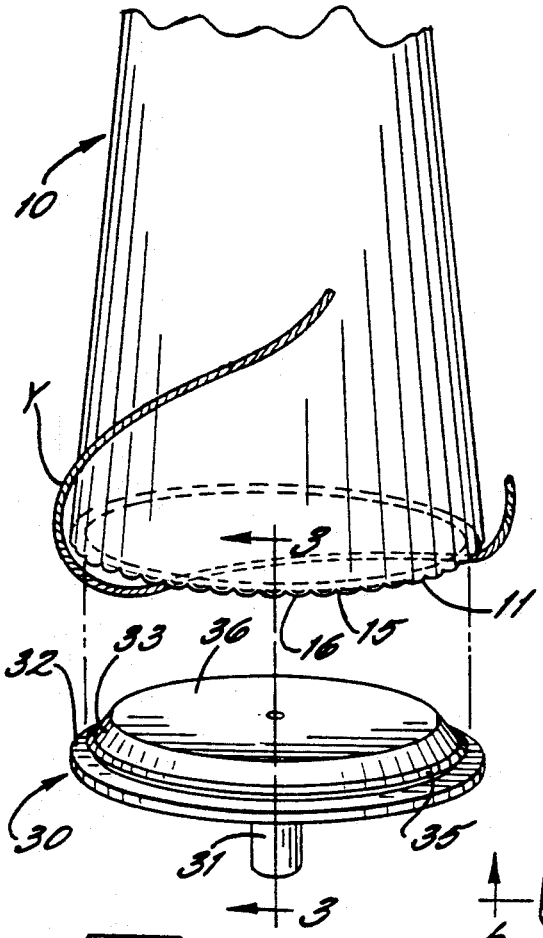
FIG. 1 is a perspective view of a textile yarn carrier and end holder cap, base plate or chuck made in accordance with the present invention with a length of yarn extended across the base of the yarn carrier for formation of a yarn tail.

FIG. 1 illustrates one preferred embodiment of a textile yarn carrier made in accordance with the present invention, indicated generally at 10. Also in FIG. 1, a preferred embodiment of an end holder cap made in accordance with the present invention is indicated generally at 30. A length of yarn Y is shown extended across the base portion 11 of the yarn carrier 10.

Figure 2:
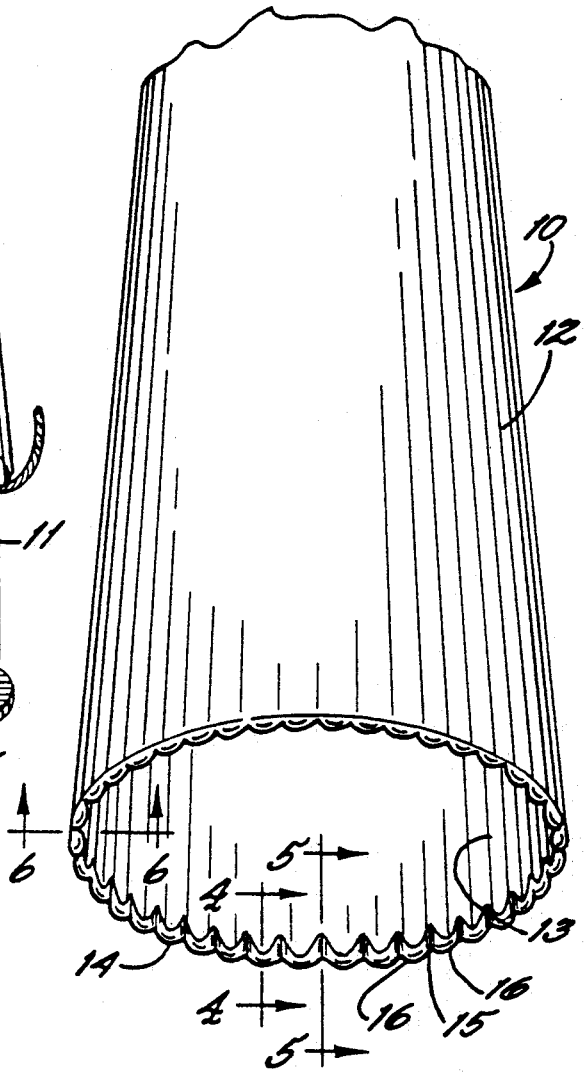
FIG. 2 is a bottom perspective view of one embodiment of a textile yarn carrier made in accordance with the present invention.

In a preferred embodiment, the yarn carrier 10 comprises a body which may be generally conical, frustroconical, cylindrical or spool-like in shape. Other suitable shapes or forms may also be used. The yarn carrier 10 may be made of a rigid polymeric material, such as polypropylene, thermoplastics, thermosetting plastics or the like, or it may also be made of paper, cardboard or the like, if desired. As shown in FIG. 2, the textile yarn carrier 10 includes an outer face 12, an inner face 13, and a bottom annular face 14 extending around the base portion 11.

The body of the carrier 10 is usually about 3.2 millimeters thick, as measured between the outer face 12 and the inner face 13 in the region of the base 11. The carrier body may also be considerably thicker, if necessary, and it may also be thinner, if desired. One embodiment has a body thickness of about 1.5 mm. The thickness of the body of the carrier 11 may vary from point to point, however, as the inner and outer faces 12 and 13 may be divergent at places. For example, the inner face 13 may be tapered in a bottom region 13*a* that extends toward the base 11. In one preferred embodiment, the angle of the tapered face 13*a*, measured relative to the base 11, is about 50 degrees.

Figure 6:
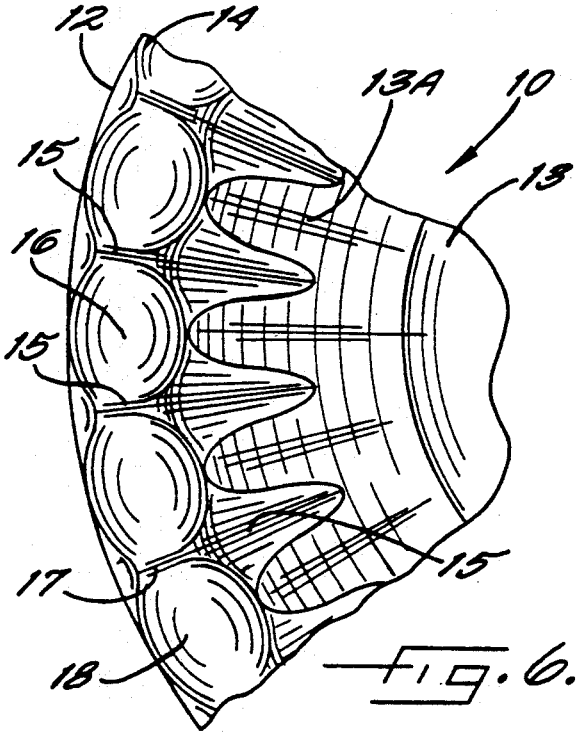
FIG. 6 is a partial broken-away view taken along line 6—6 of FIG. 2.

FIGS. 2 and 6 show a plurality of adjacent, circumferentially oriented, semielliptical concave depressions 15 formed in the bottom annular face 14 and inner face 13. FIG. 6 depicts a fragmentary portion of the bottom annular face 14 and inner face 13 of the carrier 10 and illustrates that the generally concave depressions 15 extend from the outer cylindrical face 12, across the bottom annular face 14 and upwardly along and into the bottom region 13*a* of the inner face 13. Thus, the depressions 15 form a recessed area in the inner face 13. Referring again to FIG. 2, each depression 15 is shown to be generally uniform in size and is spaced generally evenly around the periphery of the base 11 of the yarn carrier 10.

A generally convex raised area 16 is defined intermediate each depression 15. As a result, the base 11 is adapted to guide and receive a yarn tail Y into at least one yarn protecting depression on opposite sides of the carrier 10 when the yarn is extended across the bottom face 14 of the carrier 10, since a yarn tail Y that is extended across the bottom face 14 will tend to slip off of the raised areas 16 into the depressions 15. In a preferred embodiment, the sidewalls of the depressions 15 descend into the body of the carrier 10 at an average angle of about 85 degrees. This inclination has been found advantageous for directing the yarns Y from the raised are as 16 into the depressions 15. Greater or lesser angles may be used, however.

Advantageously, the width of the depressions 15, as measured between adjacent peaks 17 of the raised areas 16, is greater than the depth of the depressions 15 as measured from the peak 17 of the raised area 16 to the bottom 18 of the depression 15. The width of the depressions 15 may be greater than the diameter of yarn wound on the carrier 10, while the depth of the depressions 15 is less than the yarn diameter. Alternatively, the depth of the depressions 15 may be less than the yarn diameter so long as the passages formed between the end holder cap, base plate or chuck 30 when the carrier 10 is mounted thereon have a point of minimum central depth that is less than the yarn diameter. As explained below, the depression depth and minimum central depth of the passages may vary due to compression of the resilient material 35.

The depressions 15 may advantageously be between about three and four millimeters in width, and in one preferred embodiment, the depressions 15 are about 3.3 millimeters wide. Also in that preferred embodiment, the depressions 15 are about one millimeter deep, although the depth may be greater or smaller as necessary to achieve the advantages of the invention.

In some applications, the depth of the depressions 15 may be large enough to accommodate the yarn tail Y without substantially deforming the yarn Y when the carrier 10 is mounted on an end holder cap, base plate or chuck 30. However, in these applications the depth of the depressions 15 should be small enough, relative to the diameter of the yarn Y, to frictionally engage the yarn Y to prevent slippage of the yarn Y through the depression 15 within which it is received. This arrangement is particularly advantageous when the carrier 10 is used in connection with extremely sensitive or fragile yarns.

The number of the depressions 15 that are formed in the bottom face 14 and inner face 13 is determined by the relative size of the yarn Y and the diameter of the carrier 10. It has been found that the invention may be practiced to advantage with a carrier 10 having about fifty to seventy depressions 15. In one embodiment in which the base 11 of the carrier 10 has an inside diameter of about 65 mm, there are about sixty depressions 15 formed in the bottom face 14 and inner face 13.

Figure 3:
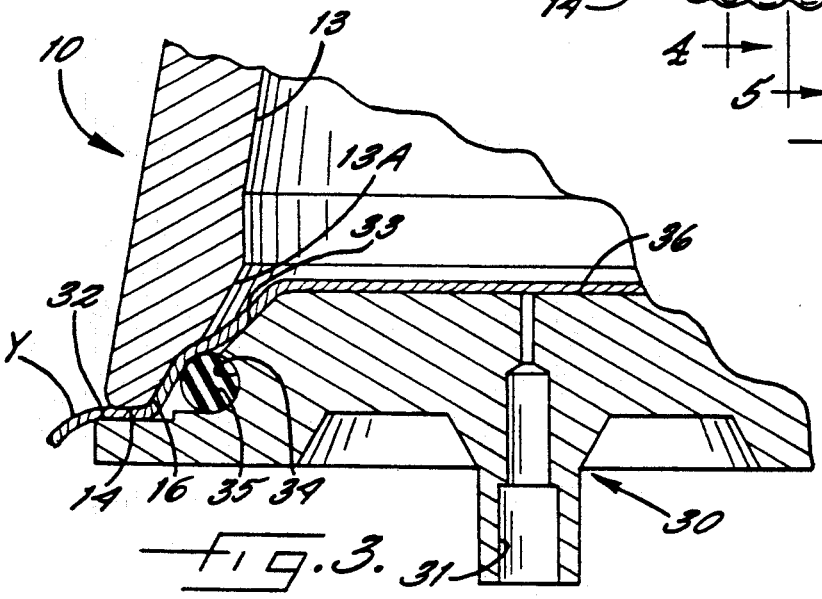
FIG. 3 is a partial cross-sectional view taken along line 3—3 of FIG. 1 and showing the textile yarn carrier and end holder cap, base plate or chuck mated together with a yarn tail extending therebetween.

The preferred end holder cap, base plate or chuck 30 for use with the yarn carrier of the invention is shown in FIGS. 1 and 3. The end holder cap 30 includes a central shaft receiving portion 31 about which the end holder cap 30 may be radially symmetrical. In a preferred embodiment, the cap 30 is rotatable about a shaft retained within the receiving portion 31. The end holder cap 30 may be made of a rigid polymeric material such as polypropylene, thermoplastics, thermosetting plastics or the like. Other rigid materials may also be used.

As best shown in FIG. 3, an annular flange 32 extends from the end holder cap 30. In the preferred embodiment, the annular flange 32 is of a suitable size and diameter for engaging the bottom annular face 14 of a yarn carrier 10. The end holder cap 30 also includes a generally frustroconical upwardly protruding face 33. The face 33 is of a suitable inclination and diameter such that it may be received in close association with the bottom region 13*a* of the inner face 13 of an associated yarn carrier 10.

The end holder cap 30 includes a groove 34 extending between the protruding frustroconical face 33 and the annular flange 32. A ring of elastomeric material 35 is received within the groove 34 such that the ring 35 is securely retained within the groove 34. In one preferred embodiment, the ring of elastomeric material 35 is a polymeric O-ring. The ring of elastomeric material 35 defines a resilient face for engaging a yarn tail Y.

In one preferred embodiment, the groove 34 is about 3 mm wide and about 1.5 mm deep, as measured from the adjacent portion of the frustroconical face 33. As a result, only a portion of the O-ring 35 is received within the groove 34, while the remaining portion of the ring 35 extends exteriorly beyond the frustroconical face 33. In one embodiment, the O-ring 35 has an inner diameter of about 50 millimeters and a thickness of about 2.5 millimeters.

The groove 34 may be spaced slightly above the annular flange 32. This slight spacing may provide for a greater degree of concave configuration relief for accommodating and protecting a yarn tail within the passages 20 formed by the depressions 15 and the end holder cap 30. The greater degree of concave configuration may be desirable, for example, if the carrier 10 and end holder cap 30 are used with yarns having a relatively coarse yarn count so that the yarn tail will not slip loose during start up of the winding process. In one embodiment, the space between the groove 34 and flange 32 is about 0.5 mm. Alternatively, the groove 34 may be formed flush with the flange 32, or a portion of the groove 34 may be recessed beneath the flange 32.

The frustroconical face 33 assists in centering the carrier 10 on the end holder cap 30 when the carrier is mounted on the cap 30. Also, as explained below, the combination of the inclined faces 33 and 13*a* has been found desirable for ensuring compatibility of closure between the carrier 10 and end holder cap 30, and more especially, to provide for rapid fulcrummatic drop away of the carrier 10 due to gravitational forces when the carrier 10 and cap 30 are used on automatic winding apparatus.

The frustroconical face 33 extends upwardly from the annular flange 32 at an angle of about 45 degrees. A greater or lesser angle of inclination may be used, as necessary; however, the 45 degree angle of inclination for the face 33 is particularly advantageous when the end hold holder cap 30 is used with a yarn carrier 10 having a face 13*a* that is inclined at an angle of about 50 degrees. This combination of inclination angles on the bottom of the carrier 10 and the face 33 ensures compatibility of closure between the carrier 10 and end holder cap 30, and provides for rapid fulcrummatic drop away of the carrier 10 due to gravitational forces when the carrier 10 and cap 30 are used on automatic winding apparatus. In such apparatus, the cap 30 is usually mounted on a generally horizontal shaft, and the carrier 10 is retained against the end holder cap 30 in a relatively horizontal position by a nose cap at its top end. After a length of yarn has been wound on the carrier 10, the nose cap is released, and the carrier 10 is permitted to fall away due to gravitational forces.

The combination of angles in the face 33 and the face 13*a* may be varied to ensure proper cooperation between the carrier 10 and end holder cap 30.

The end holder cap 30 may be made so that the annular flange 32 has an outer diameter of about 70 millimeters. In this embodiment, the face 33 has a diameter of about 62.3 mm adjacent the groove 34 and a diameter of about 58.5 mm adjacent the upper face 36. The height of the upwardly protruding portion of the cap 10 that extends above the flange 32 may be about 6.1 mm. These dimensions may be varied to accommodate yarn carriers 10 of varying configurations, heights, and diameters.

FIGS. 1 and 3 illustrate the arrangement of the yarn tail and the end cap 30 and carrier 10 during use. A yarn tail Y extends across the base portion 11 of the yarn carrier 10 and is held in place by end cap 30. Typically, the yarn carrier 10 will be mounted on and supported by the end holder cap 30 of a yarn winder machine or the like (not shown) while the yarn Y is trapped between the carrier 10 and the end holder cap 30.

Figure 4:
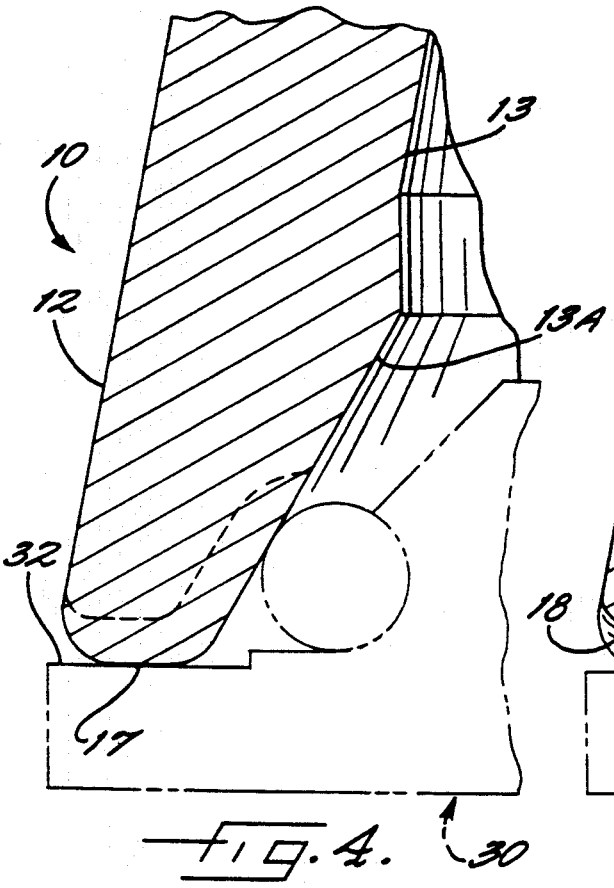
FIG. 4 is a partial cross-sectional view taken along line 4—4 of FIG. 2, which illustrates a point intermediate the yarn receiving passages.
Figure 5:
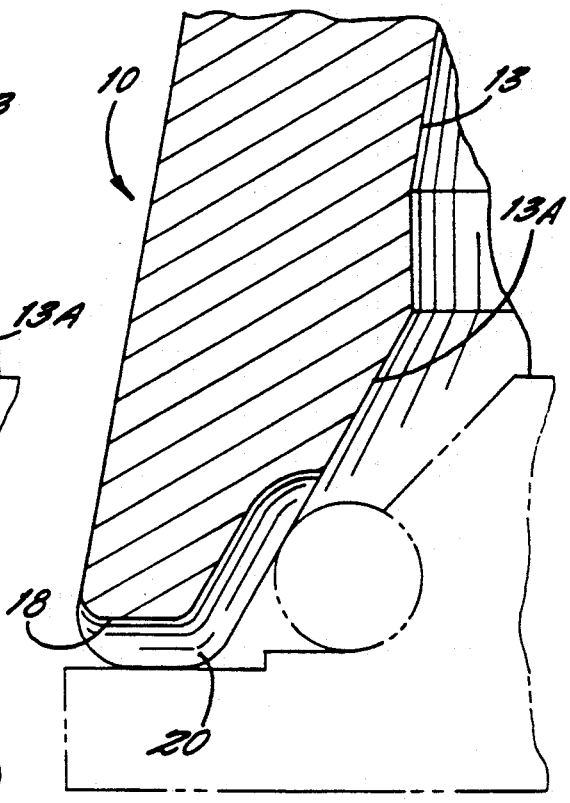
FIG. 5 is a partial cross-sectional view taken along line 5—5 of FIG. 2, which illustrates a passage formed between the yarn carrier and an end holder cap.

Engagement of the yarn carrier 10 and the end holder cap 30 creates a plurality of channels or passages 20 within which a yarn Y may be received. As specifically shown in FIG. 4, the annular flange 32 of the end holder cap 30 contacts the bottom annular face 14 of the yarn carrier 10 at points 16 intermediate each semielliptical depression 15. As shown in FIG. 5, the bottom 18 of each semielliptical depression 15 does not engage the end holder cap 30 but is instead spaced apart from the adjacent annular flange 32 and elastomeric material 35 by a small distance. Thus, each said yarn protecting depression 15 cooperates with the associated areas of the annular flange 32 and the resilient face of the elastomeric material 35 to define a passage 20.

As shown in FIG. 3, each passage 20 has a sufficient width and depth to accommodate a yarn tail Y extending between the yarn carrier 10 and end holder cap 30. However, the space between the depression 15 and associated area of the end holder cap 30 is sufficiently small such that a yarn tail Y that is received within any specific passage 20 will be frictionally engaged between the resilient face of the elastomeric material 35 and an associated depression 15. In the case where the depressions 15 are deeper than the diameter of the yarn Y, the passages 20 may have a point of minimum depth along the central axes of the passages 20 that is nonetheless smaller than the diameter of the yarn Y due to compression of the elastomeric material 35 where the material 35 contacts the parts 16, such that portions of the material 35 extend into the depressions 15, thus narrowing the passages 20.

The depth of the passages 20 may be large enough to accommodate the yarn tail Y without substantially deforming the yarn tail Y. This arrangement is significant especially when fragile or fine yarns Y are used. Additionally, the ring 35 ensures frictional contact between the end holder cap 30 and the inside face 13*a* of the carrier 10.

The textile yarn carrier 10 may be mounted on the end holder cap 30 while engaging the yarn tail Y as shown in FIGS. 1 and 3. The yarn tail Y is first positioned between the open base portion 11 of the textile yarn carrier 10 and the upper face 36 of the end holder cap 30. Next, the base portion 11 of the textile yarn carrier 10 is urged toward the end holder cap 30 so that the end holder cap 30 engages the inner cylindrical face 13 and the bottom annular face 14 of the yarn carrier 10. As the textile yarn carrier 10 and end holder cap 30 are urged into engagement with one another, the yarn tail Y is simultaneously directed into a passage 20 on opposite sides of the carrier 10 and end holder cap 30, since the yarn Y tends to slide down the inclined sidewalls between the peaks 17 of the raised areas 16 and the bottoms 18 of the depressions 15.

Following engagement, the passages 20 snugly retain the yarn tail Y extending through it in a generally radial orientation relative to the yarn carrier 10 when the yarn carrier 10 is mounted on the end holder cap 30, without breaking the yarn tail Y.

The invention has been found to be advantageous when used for automatic loading of yarn onto yarn carriers. A particularly advantageous application for the invention is its use in conjunction with an Autocoro® open-end yarn spinning machine, sold by W. Schlafhorst & Co. Maschinenfabrik of Germany. This machine includes apparatus for automatic loading of yarn onto yarn carriers. It has a feeder arm for mounting a carrier 10 onto the end holder cap 30 while a length of yarn Y is extended between the cap 30 and the carrier 10. The carrier 10 is retained against the cap 30 by a rotatable nose clamp. The end holder cap 30 and the carrier 10 are then rotated by a turning shaft of the machine. This action winds a length of yarn Y onto the carrier. Following rotation, the loaded carrier 10 and the yarn Y thereon are removed from the end holder cap 30 by a package cradle. Thereafter, if another carrier 10 is to be loaded, the machine stretches another length of yarn Y over the end holder cap 30, and another carrier 10 is loaded onto the cap 30 by the feeder arm.

The invention has been described in considerable detail with reference to its preferred embodiments.

However, it will be apparent that variations and modifications can be made within the spirit and scope of the invention as described in the foregoing detailed specification and defined in the appended claims.

What is claimed is:

1. A textile yarn carrier adapted to receive a yarn tail on the base thereof, comprising:

a body having an outer face about which yarn may be wrapped circumferentially, an inner face, and an annular bottom face at the bottom end of said body extending between said inner and outer faces; and a plurality of adjacent, circumferentially oriented semielliptical concave depressions formed in said bottom face, each of said depressions extending from said outer face radially across said bottom face and upwardly along and into said inner face to thereby form a recessed area in said inner face, said depressions being generally uniform in size and spaced generally evenly around the periphery of said body, whereby said yarn carrier comprises a base adapted to guide and receive a yarn tail in at least one yarn protecting depression on each side of said body.

2. A textile yarn carrier as defined in claim 1 further comprising a length of yarn wound on said carrier, said yarn having a yarn tail extending therefrom, and wherein each said depression has a width greater than the diameter of said yarn and a depth less than the diameter of said yarn.

3. A textile yarn carrier as defined in claim 1 further comprising yarn wound on said carrier, said yarn having a yarn tail extending therefrom, and wherein each said depression has a width greater than the diameter of said yarn and a depth that is greater than the diameter of said yarn.

4. A textile yarn carrier as defined in claim 1 wherein between about fifty and seventy said depressions are formed in said bottom face and adjacent inner face.

5. A textile yarn carrier as defined in claim 4 wherein about sixty said depressions are formed in said bottom face and adjacent inner face.

6. A textile yarn carrier as defined in claim 1 wherein said inner face has a bottom region that is tapered toward said bottom face.

7. A textile yarn carrier as defined in claim 6 wherein said bottom region is tapered at an angle of about 50 degrees relative to said bottom face.

8. A textile yarn carrier as defined in claim 1 further comprising intermediate, convex raised areas separating said concave depressions, each said convex raised area defining a peak.

9. A textile yarn carrier as defined in claim 8 wherein the maximum depth of said depressions is about 1 millimeter, as measured from said peaks of said intermediate raised areas.

10. A textile yarn carrier as defined in claim 9 wherein said depressions are between about 3 and 4 millimeters wide, as measured between said peaks of adjacent said intermediate raised areas.

11. A textile yarn carrier as defined in claim 10 wherein said depressions are wider than said intermediate raised areas.

12. A textile yarn carrier as defined in claim 1 wherein said carrier is made of a rigid polymeric material.

13. A textile yarn carrier as defined in claim 12 wherein said carrier is made of polypropylene.

14. A textile yarn carrier as defined in claim 1 wherein said carrier is made of paper.

15. A textile yarn carrier as defined in claim 1 wherein said body is generally frustroconical in shape.

16. A textile yarn carrier as defined in claim 1 wherein said body is generally cylindrical in shape.

17. A textile yarn carrier as defined in claim 1 wherein said body is generally conical in shape.

18. The combination of a textile yarn carrier and an end holder cap for supporting the yarn carrier, comprising:

a textile yarn carrier having a body with an outer face about which yarn may be wrapped circumferentially, an inner face, an annular bottom face extending between said inner and outer faces, and a plurality of adjacent semielliptical depressions extending radially across said bottom face and upwardly along and into said inner face, said depressions being generally uniform in size and spaced generally evenly around the periphery of said body, whereby said yarn carrier comprises a base adapted to guide and receive a yarn tail in at least one yarn protecting depression on each side of said body; and an end holder cap for mating with said bottom end of said textile yarn carrier, said end holder cap having an annular flange for contacting said bottom face of said yarn carrier at points intermediate each said semielliptical depression, and a resilient circumferential face for engaging said inner face of said carrier at points intermediate said depressions;

whereby when said yarn carrier is mounted on said end holder cap, each said yarn protecting depression and associated areas of said annular flange and said resilient face define a plurality of passages, each said passage having sufficient width and depth to accommodate a yarn tail overlying said bottom face of said yarn carrier but small enough that a yarn tail within any said passage is frictionally engaged between said resilient surface and said associated depression.

19. A combination as defined in claim 18 further comprising a length of yarn wound on said yarn carrier, said yarn having a yarn tail extending therefrom, and wherein each said passage has a width greater than the diameter of said yarn and a depth less than the diameter of said yarn.

20. A combination as defined in claim 18 further comprising a length of yarn wound on said yarn carrier, said yarn having a yarn tail extending therefrom, and wherein each said passage has a width greater than the diameter of said yarn and a depth that is large enough to accommodate said yarn passing through said passage without substantially deforming said yarn but which is small enough to frictionally engage said yarn to prevent slippage of said yarn within said passage.

21. A combination as defined in claim 18 wherein between about fifty and seventy said depressions are formed in said bottom face and adjacent inner face.

22. A combination as defined in claim 21 wherein about sixty said depressions are formed in said bottom face and adjacent inner face.

23. A combination as defined in claim 18 wherein said inner face has a bottom region that is tapered toward said bottom face and wherein said end holder cap has a frustroconical face upwardly protruding from said annular flange and said resilient face.

24. A combination as defined in claim 23 wherein said bottom region of said inner face is tapered at an angle of about 50 degrees relative to said bottom face, and wherein said frustroconical face of said end holder cap is inclined at an angle of about 45 degrees.

25. A combination as defined in claim 18 further comprising intermediate, convex raised areas separating said concave depressions, each convex raised area defining a peak.

26. A combination as defined in claim 25 wherein the maximum depth of said passages is about 1 millimeter.

27. A combination as defined in claim 26 wherein said passages are between about 3 and 4 millimeters wide, as measured between said peaks of adjacent said intermediate raised areas of said textile yarn carrier.

28. A textile yarn carrier as defined in claim 27 wherein said depressions are wider than said intermediate raised areas.

29. A combination as defined in claim 18 wherein said end holder cap further includes a circumferential groove extending between said radial flange and said frustroconical face, and wherein said resilient face is defined by a ring of elastomeric material retained within said groove.

30. A combination as defined in claim 29 wherein said ring of elastomeric material is a polymeric O-ring retained within said groove.

31. A combination as defined in claim 18 wherein said yarn carrier and said end holder cap are made of a rigid polymeric material.

32. A combination as defined in claim 31 wherein said rigid polymeric material is polypropylene.

33. A combination as defined in claim 18 wherein said yarn carrier is made of paper and wherein said end holder cap is made of a rigid polymeric material.

34. The combination of a textile yarn carrier and an end holder cap for supporting the yarn carrier, comprising:

a textile yarn carrier made of a rigid polymeric material and having a frustroconical body with an outer face about which yarn may be wrapped circumferentially, an inner face having a bottom region tapered at an angle of about 50 degrees, an annular bottom face extending between said inner and outer cylindrical faces, a plurality of semielliptical concave depressions extending radially across said bottom face and upwardly along and into said inner face, said depressions being generally uniform in size and spaced generally evenly around the periphery of said body, and a convex raised area defining a peak intermediate each said depression, whereby said yarn carrier comprises a base adapted to guide and receive a yarn tail in at least one yarn protecting depression on each side of said body; and an end holder cap for mating with said bottom end of said textile yarn carrier, said end holder cap being formed of rigid polymeric material and having an annular flange for contacting said bottom face of said yarn carrier at points intermediate each said semielliptical depression, a resilient circumferential face for engaging said inner face of said carrier at points intermediate said depressions, and a frustroconical face protruding upwardly from said annular flange for being received within said yarn carrier and inclined at an angle so as to cooperate with said tapered bottom region of said inner face of said carrier;

whereby when said yarn carrier is mounted on said end holder cap, each said yarn protecting depression and associated areas of said annular flange and said resilient face define a plurality of passages, each said passage having sufficient width and depth to accommodate a yarn tail overlying said bottom face of said yarn carrier but small enough that a yarn tail within any said passage is frictionally engaged between said resilient surface and said associated depression.

* * * * *